United States Patent [19]

Kugler

[11] Patent Number: 5,046,435

[45] Date of Patent: Sep. 10, 1991

[54] PROCESS AND APPARATUS FOR COMBUSTION OF WASTE, SUCH AS HOUSEHOLD AND OTHER WASTE, AND AFTERBURNING OF RESIDUES FROM THE COMBUSTION

[75] Inventor: Kurt Kugler, Markt Indersdorf, Fed. Rep. of Germany

[73] Assignee: K+K Ofenbau GmbH, Neuss, Fed. Rep. of Germany

[21] Appl. No.: 572,482

[22] Filed: Aug. 23, 1990

[30] Foreign Application Priority Data

Jan. 5, 1989 [DE] Fed. Rep. of Germany ..... 3900285
Sep. 30, 1989 [DE] Fed. Rep. of Germany ..... 3931280

[51] Int. Cl.[5] ..... F23G 5/00

[52] U.S. Cl. ..... 110/346; 110/185; 110/188; 110/190; 110/165 R; 110/171; 110/246; 110/259

[58] Field of Search ..... 110/185, 186, 259, 246, 110/188, 190, 165 R, 171, 346

[56] References Cited

U.S. PATENT DOCUMENTS

| | | | |
|---|---|---|---|
| 3,491,707 | 1/1970 | Bakker | 110/8 |
| 3,547,056 | 12/1970 | Niessen | 110/14 |
| 4,466,361 | 8/1984 | Henery et al. | 110/346 |
| 4,728,081 | 3/1988 | Nishino et al. | 110/259 X |
| 4,782,766 | 11/1988 | Lee et al. | 110/246 X |

FOREIGN PATENT DOCUMENTS

| | | | |
|---|---|---|---|
| 0141932 | 5/1985 | European Pat. Off. . | |
| 2356294 | 5/1975 | Fed. Rep. of Germany . | |
| 2539105 | 9/1975 | Fed. Rep. of Germany | 110/259 |
| 2808637 | 10/1978 | Fed. Rep. of Germany . | |
| 0091129 | 5/1985 | Japan | 110/259 |
| 0268915 | 11/1986 | Japan | 110/185 |
| WO88/06698 | 9/1988 | PCT Int'l Appl. . | |

*Primary Examiner*—Edward G. Favors
*Attorney, Agent, or Firm*—Thomas N. Ljungman

[57] ABSTRACT

This invention describes a process and apparatus for the combustion of wastes, wherein the wastes are combusted in a combustion chamber and the temperature of the combustion chamber is controlled by changing the amount of combustion air as a function of the slag flow rate. The combustion can be carried out substoichiometrically in a reducing atmosphere because of additives which are introduced into the slag in the form of fine dusts. On account of the substoichiometric operation, the requirement for fluid wastes and/or supplemental fuel is drastically reduced, the capacity of the rotary tubular kiln is increased and nitrogen oxides formation is reduced.

25 Claims, 4 Drawing Sheets

PROCESS AND APPARATUS FOR COMBUSTION OF WASTE, SUCH AS HOUSEHOLD AND OTHER WASTE, AND AFTERBURNING OF RESIDUES FROM THE COMBUSTION

REFERENCE TO RELATED APPLICATION

This application is related to International Application PCT/DE90/00005 filed on Jan. 3, 1990 designating the U.S. which claims priority from Federal Republic of Germany Patent Application No. P 39 00 285.3 filed on Jan. 5, 1989, and No. P 39 31 280.1 filed on Sept. 20, 1989.

BACKGROUND OF THE INVENTION

1. Field of the Invention

This invention relates to a process and apparatus for the combustion of special wastes and the vitrification of fine dusts in a rotary tubular kiln. Combustion installations with rotary tubular kilns are primarily designed and constructed to burn solid, pasty, sludgy and viscous special wastes, i.e. extremely heterogeneous mixtures of waste materials which can be delivered continuously, but which are delivered primarily in batches, and frequently only in containers. Combustion of such wastes in conventional household waste combustion installations would be problematic, and therefor special combustion facilities are needed.

2. Background Information

German Laid Open Patent Appln. No. 28 08 637 discloses the combustion of special waste substances in installations with rotary tubular kilns in which the rotary tubular kiln empties directly into an afterburner. The molten slag produced in the rotary tubular kiln is transported to a wet slag removal device positioned at the end of the rotary tubular kiln, underneath the afterburner chamber.

From the afterburner chamber or from the kiln charging side, a lance can be used to blow fine dust in an air current into the molten slag bath of the rotary tubular kiln. This bonds the fine dusts containing heavy metals into the slag during the burning of the waste. An alternative proposal is that the fine dusts be pelletized by means of water and binders, and then transported in containers to the rotary tubular kiln, as is done with the waste substances. An auxiliary burner which is operated with waste oil can be used to assist the combustion process in the rotary tubular kiln or in a molten slag bath inside the afterburner chamber.

This method, however, has several disadvantages. First, the combustion can be conducted only superstoichiometrically, and second, to the extent that fine dusts are introduced by an air current, a great deal of polluted air is forced through the installation, and the thermal conditions in the rotary tubular kiln allow only a very limited integration of the dusts into the slag.

On account of the various waste materials, solid, pasty, sludgy and viscous, of which the composition and combustion behavior vary greatly, extremely heterogeneous waste gases are generated in the rotary tubular kiln, both with regard to the gas composition and the gas combustion temperature.

The requirements for such rotary tubular kilns are:

1. absolute burning of the remaining solid residues which is possible in practice only with molten slags; and
2. the greatest possible burning of the waste gases, so that, in an afterburner chamber located behind the rotary tubular kiln, the burning limits for the allowable air pollution standards can be met.

In the past, the simultaneous fulfillment of these two requirements has been possible only by using large amounts of fluid waste which has a high caloric value and which also can be sprayed into the furnace via burners.

The proportion of these wastes which can be atomized, however, should be kept as low as possible for economic reasons, since such wastes can be processed more economically or can be disposed of in installations with combustion chambers. Frequently, the ratio of liquid to solid waste is out of balance, so that without additional fuels such as heating oil or natural gas, it is impossible to simultaneously meet both these requirements.

In practice, the combustion air that is not delivered by means of burners, is generally kept constant. Many attempts have been made to control the combustion air as a function of the oxygen requirement for optimal combustion, but none have ever fulfilled expectations. In batch operation, and in particular for container operation, the energy content and the combustion behavior of the wastes cannot be sufficiently estimated because the parameters; energy content, proportion of inorganic material and water, pellet size, melting behavior, degasification, reaction surface, flammability and other characteristics, can seldom be adequately determined in advance.

Moreover, the current proportion of solid matter, and thus the amount of material actually contained in a batch, may vary on account of the changing composition.

Batch operation of a combustion facility produces peak loads, and the amount of oxygen in the combustion air must be set accordingly.

To achieve a sufficient burning of the waste gas in the rotary tubular kiln even with the above-mentioned peak loads, the following minimum combustion air excesses have proven effective in practice:

greater than 1.35 for liquid waste with delivery via burners;

greater than 2.00 for continuously delivered, sludgy and pasty wastes;

greater than 3.00 for waste delivered in batches as bulk material; and greater than 3.00 for waste delivered in batches in containers.

The average combustion air excess is generally set at a value in the neighborhood at 2.5, to meet all the requirements.

Operation with viscous slags is possible at waste gas temperatures between 1050 and 1300 degrees C, with a tendency to 1300 degrees C, as a function of the composition of the inorganic waste components and possible additives. An optimal burning of the solid residues is possible only with molten slags.

For a theoretically average combustion air excess of 2.75, in relation to solid and semi-solid waste, it can be calculated that with a waste gas temperature of 1250 degrees C, only approximately 22% of the energy resulting from the waste, in relation to the lower combustion value Hu, can come from solid, sludgy and pasty waste, with the remainder having to come from liquid waste or supplementary fuel. This is not economical.

As a result of the extremely heterogeneous waste material and the high combustion air excesses, heterogeneous waste gases are formed and a correspondingly poor burning of the waste gas is achieved in the rotary tubular kiln.

In general, these rotary tubular kiln waste gases are transported directly into an afterburner chamber, where, if necessary, the temperature is then raised by the addition of liquid or gaseous fuels, and a remaining oxidation of the waste gases is conducted at low waste gas velocity and during a long hold time. This process and the construction of such furnaces with afterburners directly connected to the kilns, do not allow an intensive mixing of the waste gases. Because a good mixture of the waste gases is not achieved in the afterburner chamber and thus only a limited burning of the waste gases is occurring, the waste gases must be burned as much as possible in the rotary tubular kiln before they get to the afterburner. In relation to the above-mentioned conditions, such as combustion air excess, waste gas temperature, ratio of solid and liquid wastes, and with a typical diameter to length ratio of the rotary tubular kiln of 1:3.2, for example, approximately 100,000 to 150,000 Kcal/$m^3$h (approximately 420,000 to 640,000 kJ/$m^3$ h) can be processed.

This value is a function of:

a) the amount of waste gas, the waste gas temperature and the resulting velocity of the waste gas,
b) the hold time in the rotary tubular kiln, determined by the kiln inclination, the speed of rotation, angle of repose of the waste material, the melting behavior of the waste and the slag and the viscosity of the liquid slag,
c) the reaction surface area, determined for example by the grain size of the waste, the density of the waste, the content of inorganic material, the waste melting behavior and the charging of the individual kiln zones, i.e. the drying, degasification, combustion and afterburning zones,
d) and additional control variables, e.g. the number and size of the containers and waste charges delivered, the proportion of skin-forming substances in the slag, the concentration of salts and salt forming substances in the waste, and the possibility of adding the waste to the kiln in a uniformly-dosed manner.

In the installations of the prior art, the control of the molten slag flow and thus the vitrification of the slag is even more difficult than controlling the amount of the combustion air oxygen.

On account of the extremely high combustion air excesses in the rotary tubular kiln, a great deal of polluted air is forced through the system and needs to be heated. The efficiency of the furnace is thereby drastically reduced. With primarily solid waste material with a low caloric value, therefore, a great deal of heating oil or natural gas must be added to maintain the required minimum temperatures.

OBJECT OF THE INVENTION

Therefore, the object of the invention is to propose a process and apparatus for the combustion of special waste and the vitrification of fine dusts, in which simultaneously the efficiency of the furnace is increased and the afterburning of the waste gases is optimized.

SUMMARY OF THE INVENTION

The object is achieved according to the invention by the addition of a turbulence zone between the rotary kiln and the afterburner. This turbulence zone allows for more efficient mixing of the waste gases and therefor, more efficient burning of the waste gases after they leave the rotary kiln. Since the waste gases in this invention are more efficiently burned after they leave the kiln, the kiln combustion chamber no longer needs extremely high combustion air excesses and thus, greater efficiency is achieved because a smaller volume of air needs to be heated. Therefor, since excess heat is not needed for heating the air, the temperature in the combustion chamber can be controlled for the most economical burning of the solid waste as determined by the flow of waste slag from the kiln.

By means of the process control according to the invention, fine dusts are introduced directly into the molten slag in the rotary tubular kiln from the discharge side of the kiln, and thus, are added separately from the waste. In the prior art, these fine dusts had to be expensively stored in special dumps, while according to the present invention they can be melted with the rotary tubular kiln slag and become practically insoluble in water, thus producing a valuable filler material instead of waste.

The rotary tubular kiln is operated by means of a controlled dosing of combustion air to guarantee that the inorganic waste components, together with additives and also with the additional fine dusts, are obtained as a viscous, vitrified mass. To optimize the slag melting process, suitable inorganic additives can be mixed in directly with the material to be incinerated and the fine dusts to be melted. By means of the melting, the absolute burning of the slag is guaranteed, and the vitrification and the accompanying integration of pollutants, such as heavy metals, into the glass matrix minimizes the solubility in water as far as possible. Fine dusts, in addition to the abovementioned inorganic additives, are bonded by additional suitable organic additives, e.g. waste substances such as waste oil, tar, oil sludge and other materials to be disposed of containing hydrocarbons. These bonded fine dusts are introduced from the transition housing directly into the rotary tubular kiln slag.

As a result of preparing the fine dusts with inorganic and organic additives, the fine dusts melt all at once, and bond any volatile heavy metals into the silicate matrix of the molten products. The preparation of the dusts with inorganic and organic additives and the simultaneous spot addition of combustion air prevents the "freezing" of the slag when cold dusts are added.

The kiln rotation also causes a rapid mixing and binding of the fine dusts into the glassy slag. Since the integration of the fine dusts takes place at the furnace discharge, the hold time of the slag with the bound dust, at the high temperatures of the kiln, is short. The vaporization of heavy metals is also thereby minimized.

When operation is conducted with the melt as the regulating variable, as per the present invention, the combustion of wastes with a low caloric value takes place slightly superstoichiometrically, and the combustion of wastes with a high caloric value takes place substoichiometrically, with the substoichiometric operation being preferred.

Depending on the composition of the solid, sludgy and pasty wastes, the inflammability and quantities of these wastes added, and the size of the kiln and similar control parameters, only approximately 1.5 to 3 (Gcal/h) Gigacalories per hour (approx. 6.0 to 12.5 (GJ/h) Gigajoules per hour) of atomizable liquid wastes or appropriate supplementary fuels need to be added via burners for additional combustion energy.

Also, with substoichiometric combustion, smaller quantities of nitrogen oxides are produced during the combustion of the wastes.

By means of the process according to the invention, the combustion air excess can be drastically reduced, so that there is significantly less pollution. This has the decisive advantage that, with the same apparatus, higher waste throughputs can be achieved, or, with the same throughput, smaller facilities can be constructed.

It is also advantageous that the proportion of the liquid fuels which must be added or burned in simple combustion chambers is drastically reduced.

For waste gas temperatures greater than 1200 degrees C, special waste combustion installations of conventional construction require the following conditions, in relation to the energy content (the product of quantity times minimum caloric value) of the waste being provided:

22 to 30% solid and pasty wastes to
78 to 70% liquid waste atomized via burners.

According to the present invention, the following significantly better values can be attained:

60 to 70% solid and paste wastes to
40 to 30% liquid waste atomized via burners.

The burning of the waste gases from the rotary tubular kiln takes place in a rotary tubular kiln transition housing and a downstream afterburner chamber. Both the transition housing and the afterburner have one or more portions with narrow cross sectional areas for generating extremely high turbulence to produce optimal mixing of the waste gases. In the transition housing, activated combustion air, which has been activated and preheated to approximately 700 degrees C, can be blown in to intersect the kiln waste gas current and thus further optimize the mixing action. Thus, an optimal oxidation of the waste gases can be achieved even in the first turbulence zone.

With the pre-firing of wastes with low caloric values, it is recommended that oxygen instead of air be blown into the transition housing to guarantee that the required minimum oxygen content is present in the chimney exhaust air.

This forced mixing is more effective than the establishment of low waste gas velocities and higher temperatures, as is done in the prior art, since without the mixing a meeting of oxygen and the components to be oxidized, and thus the burning, is not possible.

Finally, according to the invention it is possible to further optimize the burning of the rotary tubular kiln waste gases in a round afterburner chamber, which burns additional waste via tangentially located burners.

The arrangement, according to the invention, of the rotary tubular kiln, the transition housing and the afterburner chamber, makes it possible to accelerate the waste gas stream in an area having a narrow cross section, and to introduce activated combustion air perpendicular to it. The transition housing therefore acts like a turbulence zone, and is effective up to the afterburner chamber for the burning of the waste gas. This type of construction has the advantage that it does not require optimization of the burning of the waste gas in the rotary tubular kiln itself, thereby allowing the combustion chamber temperature to be regulated as a function of the desired slag melt flow.

The orientation of the rotary tubular kiln on a different longitudinal axis from that of the afterburner chamber makes it possible to introduce a molten slag burner into the discharge of the rotary tubular kiln through an opening in the transition housing. This slag burner operates with pre-heated combustion air, and thus there is an additional capability of controlling the molten slag flow, primarily with changing melt behavior, without influencing the combustion process in the rotary tubular kiln.

To increase the burning of the waste gas, the afterburner can also have additional sections with narrowed cross sectional areas, which improve the mixing effect between the waste gas and introduced air, or between the waste gas and other additional substances to be burned. A tangential introduction of the waste gases into the afterburner chamber can also improve the mixing. The first turbulence zone and burner array in the afterburner chamber of the present invention is significantly lower, in terms of the height of the installation, than the last burner level in conventional special waste incinerator installations. As a result of this height difference, the combustion installations according to the invention are not much more expensive than conventional combustion installations, in spite of the additional transition housing.

Along with the molten slag burner and combustion air inlet, monitoring devices for measuring the combustion chamber temperature, the oxygen content of the waste gases, the slag viscosity and flow rate, the slag volume and transition housing temperature may also be mounted at the discharge end of the kiln in the transition housing. These monitoring devices may be remotely monitored at a remote monitoring and control station positioned a safe distance from the kiln and burning chambers. Such a monitoring and control station may be manually operated or programmably computer controlled. By monitoring the slag flow, an operator or the computer control can determine if the kiln is operating efficiently and make adjustments as necessary. Upon receipt of a signal that the slag flow is low, the controller can send a signal to the air pump or valving to increase the combustion air being let into the combustion chamber, thereby increasing combustion of the waste. Likewise, upon receipt of a signal that the slag flow is too fast, the controller can send a signal to the air pump or valving to decrease the combustion air being let into the combustion chamber, thereby decreasing the rate of combustion of the waste.

Monitoring devices for temperature and gas content may also be positioned in or near the afterburner chamber for control of the burning of the waste gases and for monitoring the exhaust gas being emitted from the afterburner to insure that it meets environmental standards. Such monitoring devices may also be manually or computer controllable from the monitoring and control station.

One aspect of the invention is a process for the combustion of waste in a combustion apparatus, the process comprising the steps of, conducting the waste to the combustion apparatus, the combustion apparatus having a loading end, a discharge end, and a combustion chamber between said loading end and said discharge end, loading the waste into the loading end of the combustion apparatus, combusting the waste in the combustion chamber at a combustion chamber temperature at which at least a portion of the waste forms a molten slag, flowing the molten slag from the combustion chamber of the combustion apparatus, out the discharge end of the combustion apparatus and into a molten slag cooling area, monitoring the flowing of the molten slag, and adjusting the combustion chamber temperature relative to the flowing of the molten slag.

DESCRIPTION OF PREFERRED EMBODIMENTS

Figure 1:
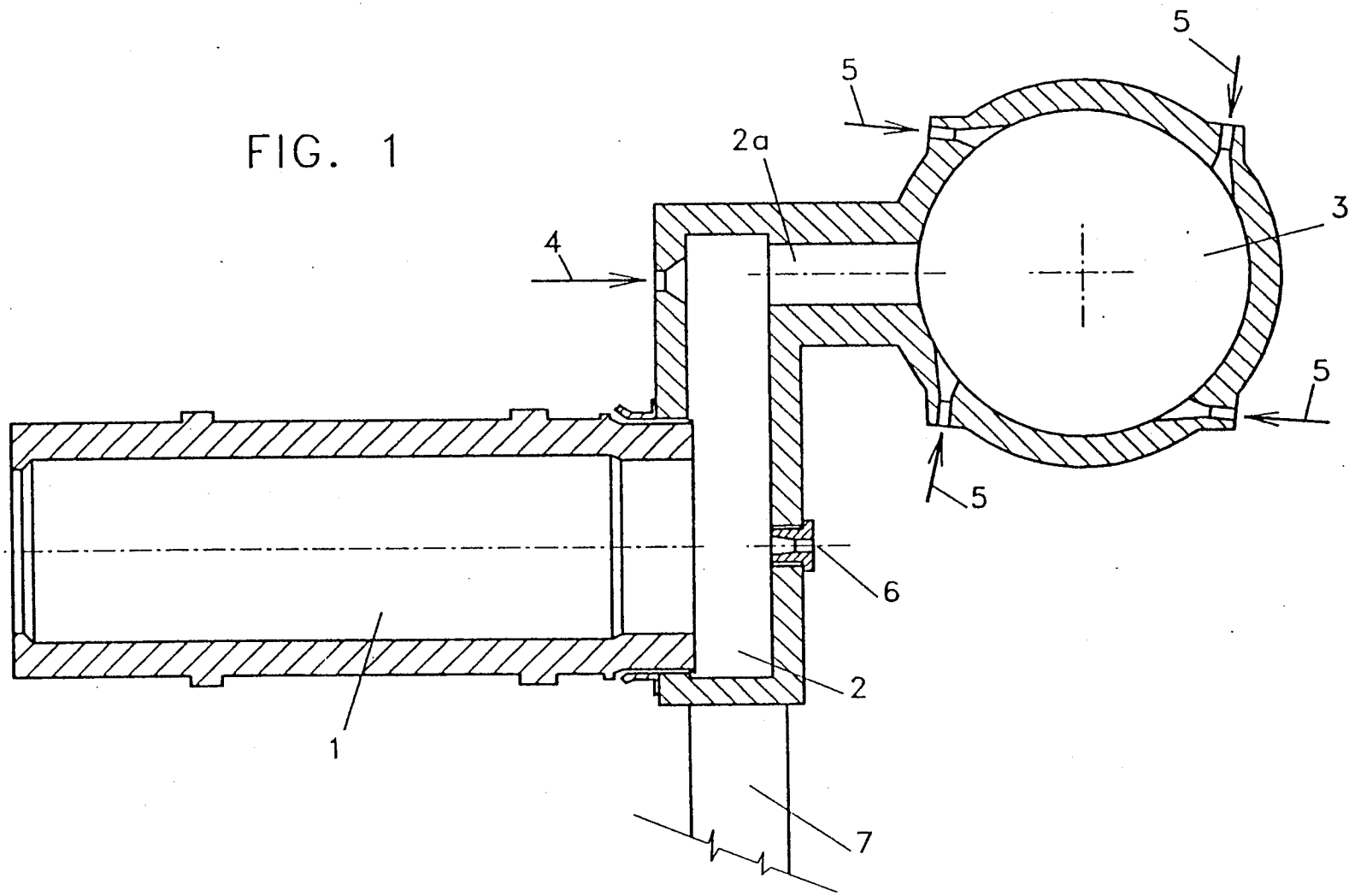
FIG. 1 shows a cross-sectional view of a combustion installation with a transition housing and an afterburner chamber.

FIG. 1 is a cross section of a rotary tubular kiln 1 and an afterburner chamber 3 on a different longitudinal axis. The kiln 1 and the afterburner chamber 3 are connected to one another by a transition housing 2 and a transition passage 2*a* with a narrower cross section than the transition housing. The rotary tubular kiln waste gases travel through the housing 2 to the narrowed chamber section 2*a*. There, the waste gases are accelerated by the injection of activated combustion air through the opening 4 and turbulence is produced, so that they are thoroughly mixed together in the narrowed cross section of passage 2*a* and are burned in the afterburner chamber. A burner can also be installed in the inlet opening 4. Additional burners and combustion air inlets can be located in the tangential inlet openings 5 of the afterburner chamber 3. An additional opening 6 has a double function. First, the fine dust delivery apparatus and an additional burner can be installed in the opening 6 of the rotary tubular kiln 1 and second, if necessary, an air intake for additional combustion air can be installed in this opening 6. Below the transition housing 2 is a wet slag removal device 7 of conventional design, to receive and cool the rotary tubular kiln slag.

Figure 2:
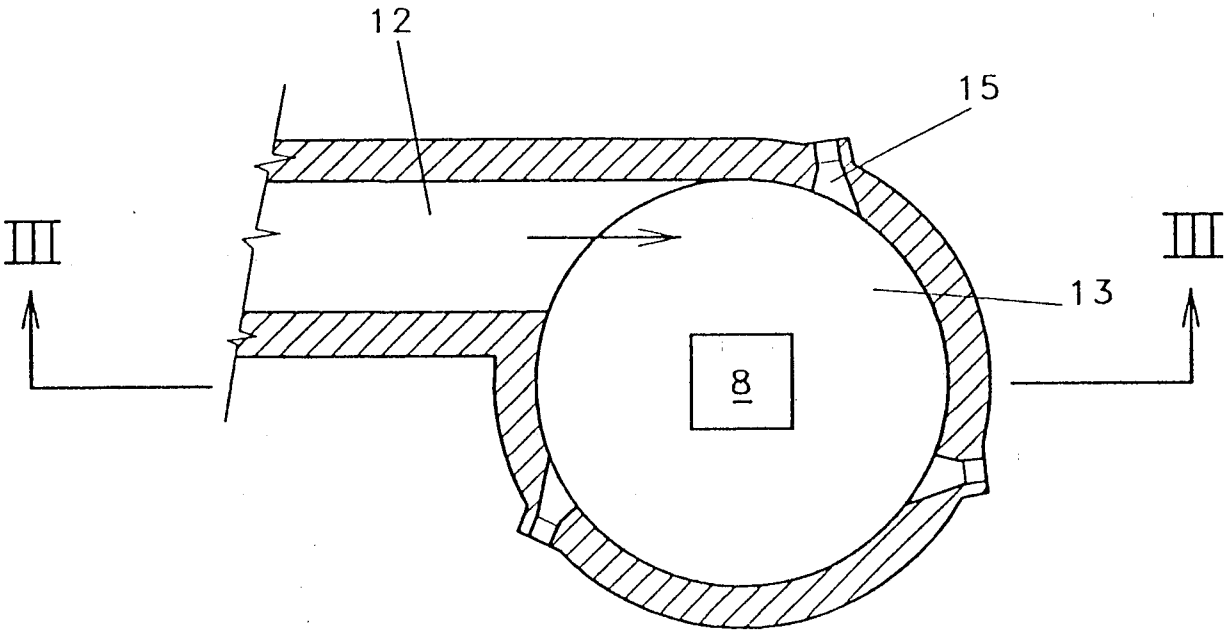
FIG. 2 shows a cross-sectional view of an alternative construction of an afterburner chamber.
Figure 3:
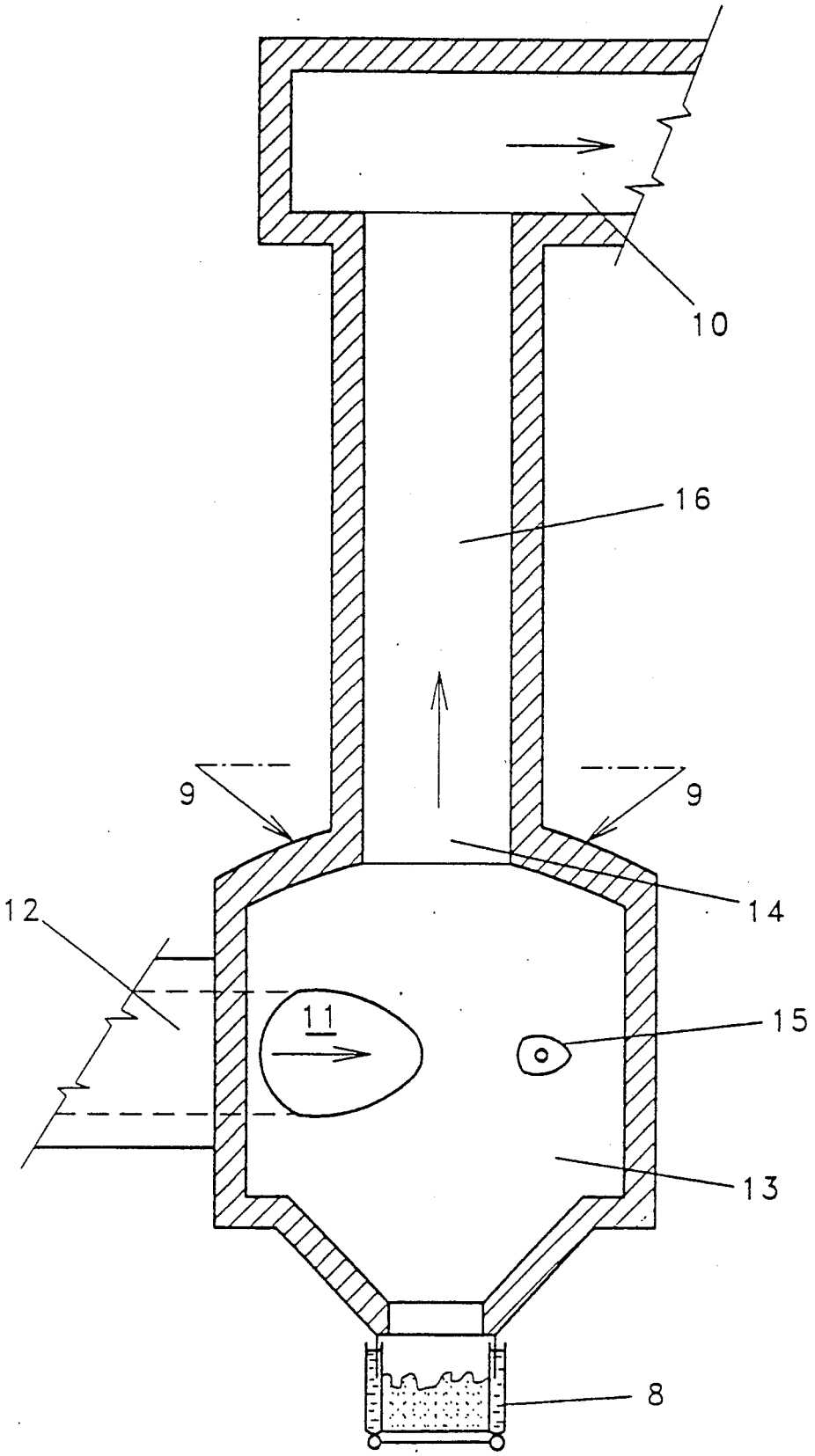
FIG. 3 shows a cross-sectional view of the afterburner chamber of FIG. 2 taken along line III/III.

FIGS. 2 and 3 illustrate an alternative construction of an afterburner chamber.

In FIG. 2, the waste gases from a rotary tubular kiln (not shown), are conducted through a transition housing 12 into the afterburner chamber 13. Tangentially located input devices 15 make it possible to introduce additional fuel (heating oil, natural gas) and/or additional liquid wastes into the afterburner chamber 13.

FIG. 3 shows a cross section through the afterburner chamber 13 along Line III—III in FIG. 2. Waste gases emerging from the mouth 11 of the transition housing 12 are subjected to afterburning in the chamber 13 with the addition of additional fuels, if necessary, through the input device 15 and combustion air through the ring main 9 and nozzles (not shown) which empty into the afterburner chamber 13. An additional narrowed cross section 14, i.e. a second turbulence zone, with a transition to the waste gas ducts 10 and/or 16, guarantees that an additional intensive mixing takes place, and that coarse flyash and molten ash are deposited in the container 8.

Figure 4:
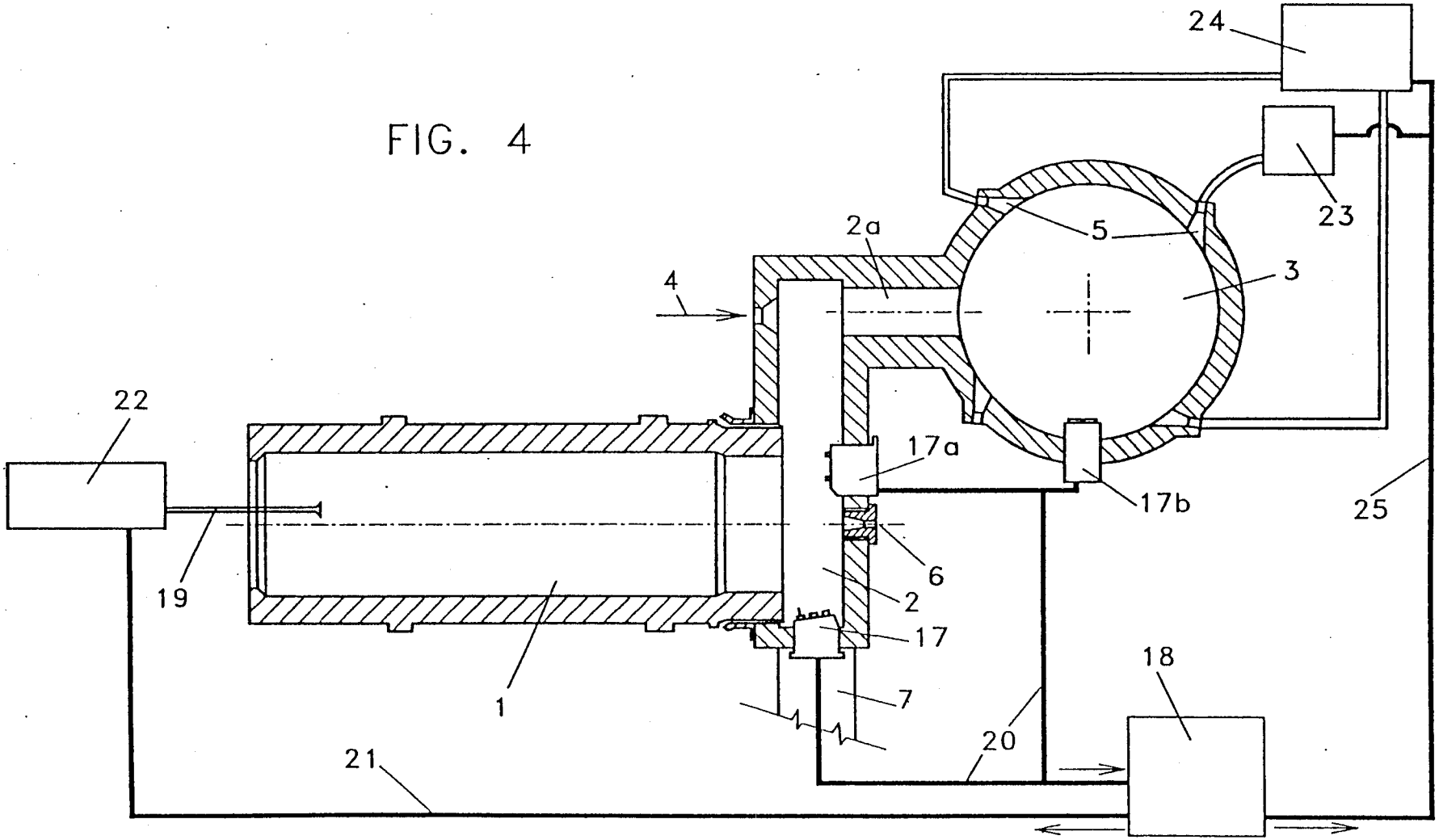
FIG. 4 shows a cross-sectional view of an alternative embodiment of the combustion installation.

FIG. 4 is a cross section of a further embodiment of the combustion installation of FIG. 1. FIG. 4 shows a cross section of the rotary tubular kiln 1 connected to the afterburner chamber 3 by the transition housing 2 and transition passage 2*a*. Additionally, a series of monitoring devices 17, 17*a* are present preferably at the discharge end of the rotary tubular kiln 1 preferably inside the transition housing 2. These monitoring devices 17, 17*a* are for monitoring at least one temperature in the combustion chamber, air oxygen content and the slag volume, viscosity and flow rate as the slag flows out of the kiln 1 into the slag bath 7 below. The monitoring devices 17, 17*a*, in one embodiment, can be remotely monitored by an operator at monitoring and control station 18 which receives signals from monitoring devices 17, 17*a* by means of electrical cable 20. From the station 18, an operator can adjust the input of combustion air flowing into the kiln 1 by transmitting a signal along electrical cable 21 to air pump or valving 22 to increase or decrease the flow of combustion air through nozzle 19. In a second embodiment, a programmable computer can be installed at monitoring and control station 18 for receiving signals and appropriately responding to them.

Along with the opening 6 which may contain a molten slag burner, a combustion air inlet or a dust inlet monitoring devices 17, 17*a* for measuring the combustion chamber temperature, the oxygen content of the waste gases, the slag viscosity and flow rate, the slag volume and transition housing temperature may also be mounted at the discharge end of the kiln 1 in or near the transition housing 2. These monitoring devices 17, 17*a* may be remotely monitored at a remote monitoring and control station 18 positioned a safe distance from the kiln 1 and burning chambers 2, 3. Such a monitoring and control station 18 may be manually operated or programmably computer controlled. By monitoring the slag flow, an operator or the computer control can determine if the kiln 1 is operating efficiently and make adjustments as necessary. Upon receipt of a signal that the slag flow is low, the controller can send a signal to the air pump or valving 22 to increase the combustion air being let into the combustion chamber of the kiln 1, thereby increasing combustion of the waste. Likewise, upon receipt of a signal that the slag flow is too fast, the controller can send a signal to the air pump or valving 22 to decrease the combustion air being let into the combustion chamber of the kiln 1, thereby decreasing the rate of combustion of the waste.

Monitoring devices for temperature and gas content 17*b* may also be positioned in or near the afterburner chamber 3 for control of the burning of the waste gases and for monitoring the exhaust gas being emitted from the afterburner 3 to insure that it meets environmental standards. Such monitoring devices 17*b* may also be manually or computer controllable from the monitoring and control station 18. Upon receipt of signals at control station 18, the controller can send appropriate signals along cable 25 to the burner apparatus 23 and air injection devices 24 positioned in openings 5 to control the burner apparatus 23 and air injection devices 24 to adjust the burning of the waste gases as needed. All of the openings 25 are preferrably connected to burner apparatus 23 and/or air injection devices 24.

The temperatures needed for the combustion of the waste gases may, for example, be in the range of 900° C. to 1500° C. or alternately of 925, 950, 975, 1000, 1025, 1050, 1075, 1100, 1125, 1150, 1175, 1200, 1225, 1250, 1275, 1300, 1325, 1350, 1375, 1400, 1425, 1450 or 1475° C. or any range defined by any two or even one of these temperatures.

The combustion temperatures, and possibly other temperatures, may be the same as the temperatures and temperature ranges indicated in the immediately above paragraph or they may possibly be above or below those temperatures and temperature ranges, if required, for ordinary and special operating conditions of the process and apparatus of the present embodiment of the invention.

A monitoring device for monitoring the temperature may be of the type specified in U.S. Pat. Nos. 4,821,219 entitled "Method for Contactless Measuring of Temperature with a Multi-channel Pyrometer," 4,533,243 entitled "Light Guide for Transmitting Thermal Radiation from Melt to Pyrometer and Method of Measuring Temperature of Molten Metal in Metallurgical Vessel with the Aid of said Light Guide" and 4,235,107 entitled "Method and Arrangement for Measuring the Physical Temperature of an Object by Means of Microwaves."

A monitoring device for monitoring the viscosity and level of slag in a container may be of the type specified in U.S. Pat. No. 4,934,561 entitled "Container Discharge Apparatus and Method Employing Microwaves", or may be of the type which monitors only the slag viscosity as specified in U.S. Pat. No. 4,723,442 entitled "High-Temperature, High-Shear Capillary Viscometer".

A monitoring device for the slag flow rate may be of the type specified in U.S. Pat. Nos. 4,608,568 entitled "Speed Detecting Device Employing a Doppler Radar", 4,184,156 entitled "Doppler Radar Device for Measuring Speed of Moving Objects" and 3,896,435 entitled "Simple Radar for Detecting the Presence, Range and Speed of Targets".

A monitoring device for the gas oxygen content may be of the type specified in U.S. Pat. Nos. 4,606,807 entitled "Probe for measuring the Carbon Potential of Endothermic Gas", 4,351,182 entitled "Oxygen Sensor for monitoring exhaust Gases", and 4,162,889 entitled "Method and Apparatus for Control of Efficiency of Combustion in a Furnace".

The types of waste which may be burned in an installation as per the invention may be of the types specified in U.S. Pat. Nos. 4,934,931 entitled "Cyclonic Combustion Device with Sorbent Injection," 4,925,389 entitled "Method and Apparatus for Treating Waste Containing Organic Contaminants," 4,640,203 entitled "Method and Apparatus for Burning Combustible Waste Materials".

The advantages of the invention lie in the ability to optimally vitrify slag and fine dusts, to optimally burn waste gases from the combustion installation, to minimize the formation of nitrogen oxides in the waste gas, to increase the throughput capacity of the rotary tubular kiln, and to drastically reduce the requirement for liquid waste and/or additional fuels.

In summary, one feature of the invention resides broadly in the process for the combustion of special wastes and vitrification of fine dusts in a rotary tubular kiln to which the wastes are conducted and from which, at the discharge side, non-gaseous wastes are transported into a molten slag bath and waste gases, which are produced during combustion of the waste in the rotary tubular kiln, are burned in an afterburner chamber and, if necessary, any of the combustion chambers of the kiln and afterburner are equipped with auxiliary burners, wherein the process is characterized by the fact that in the rotary tubular kiln 1, the combustion chamber temperature is controlled as a function of the molten flow of the slag by changing the amount of combustion air, allowing for possible substoichiometric combustion.

Another feature of the invention resides broadly in the process characterized by the fact that the formation of nitrogen oxides is minimized by the addition of additives with substoichiometric combustion in a reducing atmosphere.

Yet another feature of the invention resides broadly in the process characterized by the fact that bonded fine dusts are used as the additive substances.

A further feature of the invention resides broadly in the process characterized by the fact that inorganic additive substances are added to the rotary tubular kiln as a function of the slag development and the melting behavior of the fine dust, and vitrification agents are added to the fine dusts if necessary.

A yet further feature of the invention resides broadly in the process characterized by the fact that the fine dusts are bonded and made to melt more rapidly by reaction or wetting with one or more of the substances from the group consisting of: waste oil, oil sludge, resins, tar and other binders which can be used as energy sources.

Yet another further feature of the invention resides broadly in the process characterized by the fact that the fine dusts are delivered from the output side of the rotary tubular kiln through an opening 6 in a transition housing 2 directly into the molten slag bath.

An additional feature of the invention resides broadly in the process characterized by the fact that the molten slag flow is controlled by additional burners at the outlet of the rotary tubular kiln 1.

A yet additional feature of the invention resides broadly in the process characterized by the fact that the burning of the waste gases is intensified in at least one turbulence zone, and, if appropriate by the injection of preheated combustion air and/or oxygen which produce turbulence in the waste gas stream.

A further additional feature of the invention resides broadly in the process characterized by the fact that additional wastes and/or combustion air are introduced into the afterburner chamber 3, 13.

A yet further additional feature of the invention resides broadly in the apparatus for the combustion process which includes, a rotary tubular kiln and a rotary tubular kiln discharge with a wet slag removal device, a fine dust input device, auxiliary burners, an afterburner chamber, air introduction devices and kiln control devices, wherein the apparatus is characterized by the fact that, ahead of the afterburner chamber 3, 13, there is a turbulence zone *2a*, 12, which does not lie on the axis of the rotary tubular kiln.

Another further additional feature of the invention resides broadly in the apparatus characterized by the fact that there is a transition housing 2 between the rotary tubular kiln 1 and the afterburner chamber 3, 13 with openings 4, 6 for means to control the combustion process.

A yet another additional feature of the invention resides broadly in the apparatus characterized by the fact that the waste gas inlet 12 from the transition housing 2 into the afterburner chamber 13 is oriented tangentially, and the afterburner chamber 13 is divided into zones 13, 14, and 16 having different cross sections.

Another yet further feature of the invention resides broadly in the apparatus characterized by the fact that there is an inlet device 9 for combustion air in the chimney section 14 between the zones.

A still further feature of the invention resides broadly in the apparatus characterized by the fact that, beyond the narrow transition cross section *2a*, 12, in the afterburner chamber 3, 13, there are additional waste burners and combustion air injection openings 5, 15 tangentially positioned at the level of the waste gas inlet 11.

A still further additional feature of the invention resides broadly in the use of a rotary tubular kiln 1 with downstream waste gas combustion for the joint combustion of special wastes and for the vitrification of fine dusts, to which are added oxidizing substances and/or substances to control the molten slag flow from the outlet side.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A process for the combustion of waste in a combustion apparatus, said process comprising the steps of:

conducting the waste to said combustion apparatus, said combustion apparatus having a loading end, a discharge end, and a combustion chamber between said loading end and said discharge end;

loading the waste into said loading end of said combustion apparatus;

flowing combustion air into said combustion chamber;

combusting the waste in said combustion chamber at a combustion chamber temperature at which at least a portion of the waste forms a molten slag;

flowing the molten slag from said combustion chamber of said combustion apparatus, out said discharge end of said combustion apparatus and into a molten slag cooling area, the molten slag flow having a flow rate;

monitoring the flow rate of the molten slag; and adjusting at least one of:

the quantity of combustion air flowing into said combustion chamber, and said combustion chamber temperature relative to the flow rate of the molten slag.

2. The process for the combustion of waste according to claim 1, wherein said combusting is one of:

superstoichiometric combustion; and substoichiometric combustion.

3. The process for the combustion of waste according to claim 2, further including adding additives to the molten slag, said additives along with said substoichiometric combustion in a reducing atmosphere minimizing the formation of nitrogen oxides.

4. The process for the combustion of waste according to claim 3, wherein said additives comprise dusts, said dusts bonding and melting by at least one of: reaction with and wetting with at least one of the following substances: waste oil, oil sludge, resins, tar and binders, at least a portion of said substances providing additional sources of energy for said combustion.

5. The process for the combustion of waste according to claim 4, further including vitrifying said dusts by adding said dusts directly into said molten slag at said discharge end of said combustion apparatus.

6. The process for the combustion of waste according to claim 5, further including combining said dusts with vitrification agents before said addition of said dusts into said molten slag.

7. The process for the combustion of waste according to claim 6, further including the addition of inorganic additive substances to said combustion apparatus in relation to said slag formation and said vitrification of said dusts.

8. The process for the combustion of waste according to claim 7, further including burners positioned at said discharge end of said combustion apparatus for controlling said flowing of said molten slag in relation to slag formation by burning said slag with said burners positioned at the discharge end of said combustion apparatus.

9. The process for the combustion of waste according to claim 8, wherein said combustion apparatus comprises a rotary tubular kiln, said rotary tubular kiln having a longitudinal axis, said longitudinal axis having a first end and a second end, said first end of said axis being said loading end and said second end of said axis being said discharge end, said rotary tubular kiln being connected at said discharge end to an afterburner chamber by means of a transition housing, said transition housing having a longitudinal axis and said longitudinal axis of said transition housing being aligned in a direction offset from the direction of alignment of said longitudinal axis of said rotary tubular kiln.

10. The process for the combustion of waste according to claim 9, wherein said transition housing includes first opening means, said first opening means comprising at least one of:

means for said adding of said dust directly into the molten slag bath;

means for admitting combustion air into said combustion chamber; and said burners for said control of said flow of slag.

11. The process for the combustion of waste according to claim 10, further including venting waste gases from said combustion of the waste into said transition housing.

12. The process for the combustion of waste according to claim 11, wherein said transition housing comprises at least one turbulence zone for mixing of said waste gases and mixing said waste gases by turbulence in said turbulence zone.

13. The process for the combustion of waste according to claim 12, further including burning a portion of said waste gases in said transition housing.

14. The process for the combustion of waste according to claim 13, wherein said transition housing comprises a second opening means and further including admitting at least one: combustion air and oxygen into said transition housing through said second opening means in said transition housing, said at least one of said combustion air and said oxygen for additionally mixing and burning of said portion of said waste gases.

15. The process for the combustion of waste according to claim 14, wherein said afterburner chamber comprises a waste gas inlet and further including venting unburned waste gases from said transition housing into said afterburner chamber through said waste gas inlet, said afterburner chamber having a cylindrical inner wall, and said waste gas inlet being oriented tangentially with respect to said cylindrical inner wall.

16. The process for the combustion of waste according to claim 15, further including mixing said unburned waste gases in a plurality of turbulence zones within said afterburner chamber, said plurality of turbulence zones each defining a different cross-sectional area.

17. The process for the combustion of waste according to claim 16, further including burning said unburned waste gases in said afterburner chamber.

18. The process for the combustion of waste according to claim 17, further including monitoring said burning of said unburned waste gases in said afterburner chamber.

19. The process for the combustion of waste according to claim 18, further including adding combustion air into said afterburner chamber through an inlet device mounted between a first and second of said turbulence zones of said afterburner chamber.

20. The process for the combustion of waste according to claim 19, wherein said first turbulence zone comprises additional waste burners, said additional waste burners being positioned tangentially with said cylindrical inner wall in a linear arrangement with said gas inlet and said additional burners for enhancing said burning of said unburned waste gases in said first turbulence zone.

21. The process for the combustion of waste according to claim 20, wherein said first turbulence zone comprises injection openings, said injection openings being positioned tangentially with respect to said cylindrical inner wall in a linear arrangement with said gas inlet and said injection openings for injecting additional combustion air for enhancing said burning of said unburned waste gases in said first turbulence zone.

22. The process for the combustion of waste according to claim 21, wherein said waste is special household waste which cannot be burned in conventional household waste combustion installations, said waste including at least one of: solid, pasty, viscous and sludgy wastes.

23. Apparatus for the combustion of waste, said apparatus comprising:

a loading end, a discharge end, and a combustion chamber between said loading end and said discharge end;

means for conducting the waste to said combustion chamber;

means for conducting a flow of combustion air to said combustion chamber;

means for combusting the waste in said combustion chamber at a combustion chamber temperature at which at least a portion of the waste forms a molten slag;

means for flowing the molten slag from said combustion chamber of said combustion apparatus, out said discharge end of said combustion apparatus and into a molten slag cooling area, the molten slag flow having a flow rate;

means for monitoring the flow rate of the molten slag; and means for adjusting at least one of:

the flow of combustion air into said combustion chamber, and said combustion chamber temperature relative to the flow rate of the molten slag.

24. Apparatus for the combustion of waste according to claim 23, wherein said combustion apparatus comprises a rotary tubular kiln, said rotary tubular kiln having a longitudinal axis, said longitudinal axis having a first end and a second end, said first end of said axis being said loading end and said second end of said axis being said discharge end, said rotary tubular kiln comprising a dust input device, auxiliary burners, an afterburner chamber, air introduction devices and kiln control devices, said rotary tubular kiln being disposed for discharging the slag from said discharge end into a wet slag removal device, said rotary tubular kiln being connected at said discharge end to said afterburner chamber by means of a transition housing, said transition housing having a longitudinal axis and said longitudinal axis of said transition housing being aligned in a direction offset from the direction of alignment of said longitudinal axis of said rotary tubular kiln, said transition housing comprising opening means, said opening means comprising at least one of: burner means and air injection means for control of said combusting, said afterburner chamber comprising a cylindrical inner wall and a waste gas inlet through which waste gases from said transition housing are vented, said waste gas inlet being oriented tangentially with respect to said cylindrical inner wall, said transition housing comprising a plurality of turbulence zones for mixing said waste gases, said turbulence zones each defining a different cross-sectional area, said afterburner chamber comprising an air inlet device for admitting air into said afterburner chamber, said air inlet device being positioned between a first and a second said turbulence zone, said afterburner chamber comprising waste burners and combustion air injection openings for controlling combustion in said afterburner chamber, said waste burners and said air injection devices being oriented tangentially with respect to said cylindrical inner wall, and said burners and said air injection devices being linearly arranged with said waste gas inlet.

25. Use of a rotary tubular kiln having an inlet side and an outlet side in a process having downstream waste gas combustion of gases from the outlet side of the kiln for jointly combusting wastes and for melting additive dusts; adding at least one of: oxidizing substances and substances other than oxidizing substances for controlling molten slag flow from the outlet side of the kiln; and said downstream waste gas combustion comprising combustion of waste gas from the outlet side of the kiln.

* * * * *

UNITED STATES PATENT AND TRADEMARK OFFICE

CERTIFICATE OF CORRECTION

PATENT NO. : 5,046,435

DATED : September 10, 1991

INVENTOR(S) : Kurt KUGLER

It is certified that error appears in the above-identified patent and that said Letters Patent is hereby corrected as shown below:

On the title page, under the Foreign Application Priority Data section indicated by the INID code [30], on line 2, delete "Sep. 30, 1989" and insert --Sep. 20, 1989--.

On the title page, insert a new INID code section [63], directly under INID code section [22]. This should read:

--Related U.S. Application Data

[63] Continuation-in-part of PCT/DE90/00005, filed on Jan. 3, 1990.--

In column 1, line 8, after 'is', delete "related to" and insert --a continuation in part--.

In column 1, line 11, after 'Patent", delete "Application" and insert --Applications--.

UNITED STATES PATENT AND TRADEMARK OFFICE

CERTIFICATE OF CORRECTION

PATENT NO. : 5,046,435

DATED : September 10, 1991

INVENTOR(S) : Kurt Kugler

It is certified that error appears in the above-identified patent and that said Letters Patent is hereby corrected as shown below:

Column 13, claim 19, line 19, afger "and", insert--a--.

Signed and Sealed this

Fifteenth Day of June, 1993

*Attest:*

Michael K. Kirk

MICHAEL K. KIRK

*Attesting Officer*

*Acting Commissioner of Patents and Trademarks*